US007915508B2

(12) United States Patent
Shimizu

(10) Patent No.: US 7,915,508 B2
(45) Date of Patent: Mar. 29, 2011

(54) KEYBOARD ASSEMBLY FOR PLAYING MUSIC AUTOMATICALLY

(75) Inventor: Motohide Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 72 days.

(21) Appl. No.: 12/048,472

(22) Filed: Mar. 14, 2008

(65) Prior Publication Data

US 2008/0223195 A1 Sep. 18, 2008

(51) Int. Cl.
*G10C 3/12* (2006.01)

(52) U.S. Cl. ..... 84/423 R

(58) Field of Classification Search ..... 84/43–438, 84/423 R

See application file for complete search history.

(56) References Cited

U.S. PATENT DOCUMENTS 5,824,928 A * 10/1998 Kumano et al. ..... 84/423 R
5,942,705 A * 8/1999 Kumano et al. ..... 84/402

FOREIGN PATENT DOCUMENTS

JP 2555777 8/1997
JP 09-237082 A 9/1997

OTHER PUBLICATIONS

Chinese Office Action mailed Mar. 10, 2010, for CN Application No. 200810086173.4, seven pages.

* cited by examiner

*Primary Examiner* — Kimberly R Lockett
(74) *Attorney, Agent, or Firm* — Morrison & Foerster LLP

(57) ABSTRACT

A keyboard assembly for playing music automatically comprises: a plurality of juxtaposed keys including white keys and black keys, each being supported swingable for depression and release thereof; a plurality of juxtaposed swing weights, each for each of the keys and each being supported swingable as interlocked with the corresponding key; and a plurality of actuator devices, each for each of the swing weights to actuate the swing weight, which in turn drives the interlocked key to swing to its depressed position. The actuator devices are arrayed alternately in two rows with the arraying pitch between the actuator devices for the adjacent swing weights made different from the arraying pitch between the swing weights so that the actuator devices for the keys of C through E can be disposed closer to the C end and the actuator devices for the keys of F through B can be disposed closer to the B end, thereby securing a fitting space between the E actuator device and the F actuator device. Alternatively, the actuator devices may be equally spaced within the octave, while the swing weights are spaced unequally.

8 Claims, 9 Drawing Sheets

Keyboard Assembly with Actuators (Side View)

Actuating Mechanism (Plan View)

Actuating Mechanism (Side View)

KEYBOARD ASSEMBLY FOR PLAYING MUSIC AUTOMATICALLY

TECHNICAL FIELD

The present invention relates to a keyboard assembly for playing music automatically in which the keys in the keyboard are physically actuated by means of key actuator devices to play back musical notes along with the music playing data signals, and more particularly, to a keyboard assembly for playing music automatically by physically actuating the keys by means of key actuator devices along with the music playing data signals in which the key actuator devices are optimally disposed without being restricted to the disposition of the keys.

BACKGROUND INFORMATION

Conventionally known in the art is a keyboard assembly for playing music automatically by physically actuating the keys by means of key actuator devices to play back musical notes automatically along with the music playing data signal. An example of such a keyboard assembly is disclosed in registered Japanese utility model publication No. 2,555,777.

The keyboard assembly disclosed in the above referenced publication comprises a plurality of keys, each supported swingably on a key fulcrum, and a same plurality of actuator devices of a solenoid plunger type, each disposed in correspondence to each of the keys. The solenoid plungers are arrayed alternately one after another (zigzag) in two rows in the direction of the key juxtaposition. The tip of the plunger member included in the solenoid plunger pushes up the rear end part of the corresponding key from underneath to actuate the key to its depressed position.

More specifically, the actuator devices for the odd-numbered keys (C, D, E, F#, G#, A#) in an octave are arrayed in one of the two rows (e.g. the rear row), while the actuator devices for the even-numbered keys (C#, D#, F, G, A, B) in an octave are arrayed in the other of the two rows (e.g. the front row), in order to realize an efficient disposition of the actuator devices. Further, each actuator device is disposed under each corresponding key at its laterally central position, i.e. on the center line of the width (the dimension in the direction of the key juxtaposition) and accordingly all the actuators are arrayed with the same spacings as all the keys.

It should be noted, however, that the spacings among the keys including twelve keys (seven white keys and five black keys) per octave are not the same in the octave with the keyboards for ordinary keyboard musical instruments, except the keyboards for some types of toy musical instruments. The key spacing between the adjacent keys among the C through E keys is wide and that among the F through B keys is narrow in the ordinary keyboard. Thus, the actuator devices are to be disposed with the wide spacing for the C through E keys and with the narrow spacing for the F through B keys.

The actuator devices are usually designed with the common dimensions for all the keys so as not to increase the number of model kinds, and in addition the dimensions are determined so that the actuator devices can be located in a limited area in the keyboard assembly. This will limit the size of the actuator device to be accommodated in the region of the narrow key spacing.

The bigger the actuator device is sized, the higher efficiency per power consumption will be obtained. In other words, the inductance L of a solenoid coil is proportional to the square of the cross-sectional area of the core (or the ring of the wound coil) and the square of the number of turns of the coil, and is inversely proportional to the length of the magnetic path. This means, a bigger-sized actuator device can contain a core having a larger cross-sectional area, which in turn shows a larger inductance L, thereby giving higher efficiency. In order to make the electric power to be a desired value at the initial moment of the current flow through the coil, the larger the inductance L is, the smaller the required electric current is.

As in the case of the conventional keyboard assembly, where there are size limitations for the actuator device, a small-sized actuator device would necessitate a bigger power supply source to secure a necessary actuation force. A bigger power supply, however, will be disadvantageous from the viewpoint of electric power consumption as well as from the viewpoint of heat generation by the coil. This will discourage the miniaturization of the entire keyboard assembly.

Moreover, in the conventional keyboard assembly, the disposition of the actuator devices is completely dependent on the disposition of the keys, which provides little freedom for designing. There may be the necessity of providing fixing members such, as screws to fix the actuator devices or the yokes to the keyboard assembly and providing various components such as a temperature sensor for a fail-safe system. But, as the actuator devices are to be disposed under such restrictions, it is difficult to secure spaces as well as to find optimum places for providing those various components.

Also known in the art is a keyboard assembly comprising swing weights, each for each key, for introducing inertia in the key movement by swinging as interlocked with the key, in which the actuator device actuates the corresponding swing weight, which in turn actuates the corresponding key to swing to the depressed position. In such a keyboard assembly, where the keyboard frame is made of plastic material, several ribs will be provided to reinforce the structure, which will require the swing weights to be positioned by circumventing the ribs. Thus, the swing weights cannot be arrayed with equal spacing, which causes a wider space region and a narrower space region. As a result in this case, the disposition of the actuator devices with respect to the swing weights contains the same problem as mentioned above in connection with the disposition of the actuator devices with respect to the keys.

SUMMARY OF THE INVENTION

In view of the foregoing circumstances, therefore, it is a primary object of the present invention to provide a keyboard assembly for playing music automatically, in which the actuator devices can be designed as large as possible itself, yet providing necessary spaces for disposing the fixing members and the necessary components, thereby providing high freedom for designing.

According to the present invention, the object is accomplished by providing a keyboard assembly for playing music automatically comprising: a plurality of juxtaposed keys including white keys and black keys and arrayed from left to right over octaves, each being supported swingable in a direction of depression and release thereof; a plurality of swing weights juxtaposed in parallel with and respectively corresponding to the juxtaposed keys, each of the swing weights being supported swingable as interlocked with the corresponding one of the keys; and a plurality of actuator devices, each being provided in correspondence to each of the swing weights to actuate the corresponding swing weight, which in turn drives the interlocked key to swing to its depressed position, wherein a distance, in the direction of the juxtaposition, between a pair of actuator devices corresponding to a pair of the juxtaposed keys within an octave is different from a distance, in the direction of the juxtaposition, between a pair of the juxtaposed swing weights corresponding to the pair of the juxtaposed keys within the octave. As the spacings among the actuator devices are not restricted to the spacings among the swing weights, high freedom for designing the actuator devices can be enjoyed, for example, in providing spaces for disposing components and fixing members or in maximizing the size of the actuator device.

In an aspect of the present invention, the actuator devices may preferably be spaced equally within an octave, while the swing weights are spaced unequally within the same octave. Thus, the actuator device can be maximized in size.

In another aspect of the present invention, each of the actuator devices may preferably be arranged in two rows which are defined in parallel to the direction of the key juxtaposition, and wherein the actuator devices which correspond to odd-numbered swing weights as counted from the left within each of the octaves are arranged in one of the two rows while the actuator devices which correspond to even-numbered swing weights as counted from the left within each of the octaves are arranged in the other of the two rows. Thus, the actuator devices can be arrayed efficiently in space by the zigzag disposition, while the size can be maximized.

According to the present invention, the object is further accomplished by providing a keyboard assembly for playing music automatically comprising: a plurality of juxtaposed keys including white keys and black keys and arrayed from left to right over octaves, each being supported swingable in a direction of depression and release thereof; a plurality of actuator devices, each being provided in correspondence to each of the keys to actuate the corresponding key to swing to its depressed position, wherein a distance, in the direction of the juxtaposition, between a pair of actuator devices corresponding to a pair of the juxtaposed keys within an octave is different from a distance, in the direction of the juxtaposition, between a pair of the juxtaposed keys within the octave. As the spacings among the actuator devices are not restricted to the spacings among the keys, high freedom for designing the actuator devices can be enjoyed, for example, in providing spaces for disposing components and fixing members or in maximizing the size of the actuator device.

In a still further aspect of the present invention, the actuator devices may preferably be spaced equally within an octave, while the keys are spaced unequally within the same octave. Thus, the actuator device can be maximized in size.

In a still further aspect of the present invention, each of the actuator devices may be arranged two rows which are defined in parallel to the direction of the key juxtaposition, and wherein the actuator devices which correspond to odd-numbered keys as counted from the left within each of the octaves are arranged in one of the two rows while the actuator devices which correspond to even-numbered keys as counted from the left within each of the octaves are arranged in the other of the two rows. Thus, the actuator devices can be arrayed efficiently in space by the zigzag disposition, while the size can be maximized.

In a still further aspect of the present invention, each of the keys may have an actuated member in the form of a protrusion extending from the key on the center line of the key width (i.e. the dimension in the direction of the key juxtaposition) toward the actuator device, and wherein each of the actuator devices may have an actuating member to actuate the actuated member protrusion of the corresponding key to cause the key to swing to its depressed position. With this arrangement, the key receives an actuating force at the center of its width from the actuator device so that no rolling movement will be caused even if the key and the actuator device are staggered with respect to each other in the direction of their juxtapositions, which will ensure a correct key depression as well as increase the durability of the keyboard assembly.

In a still further aspect of the present invention, the actuating member may have a tip surface having a first area facing toward the actuated member and the actuated member may have a tip surface having a second area facing toward the actuating member, the first area being greater than the second area. This arrangement will allow some tolerance in the axial alignment between the actuating member and the actuated member.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

First Embodiment

Figure 1:
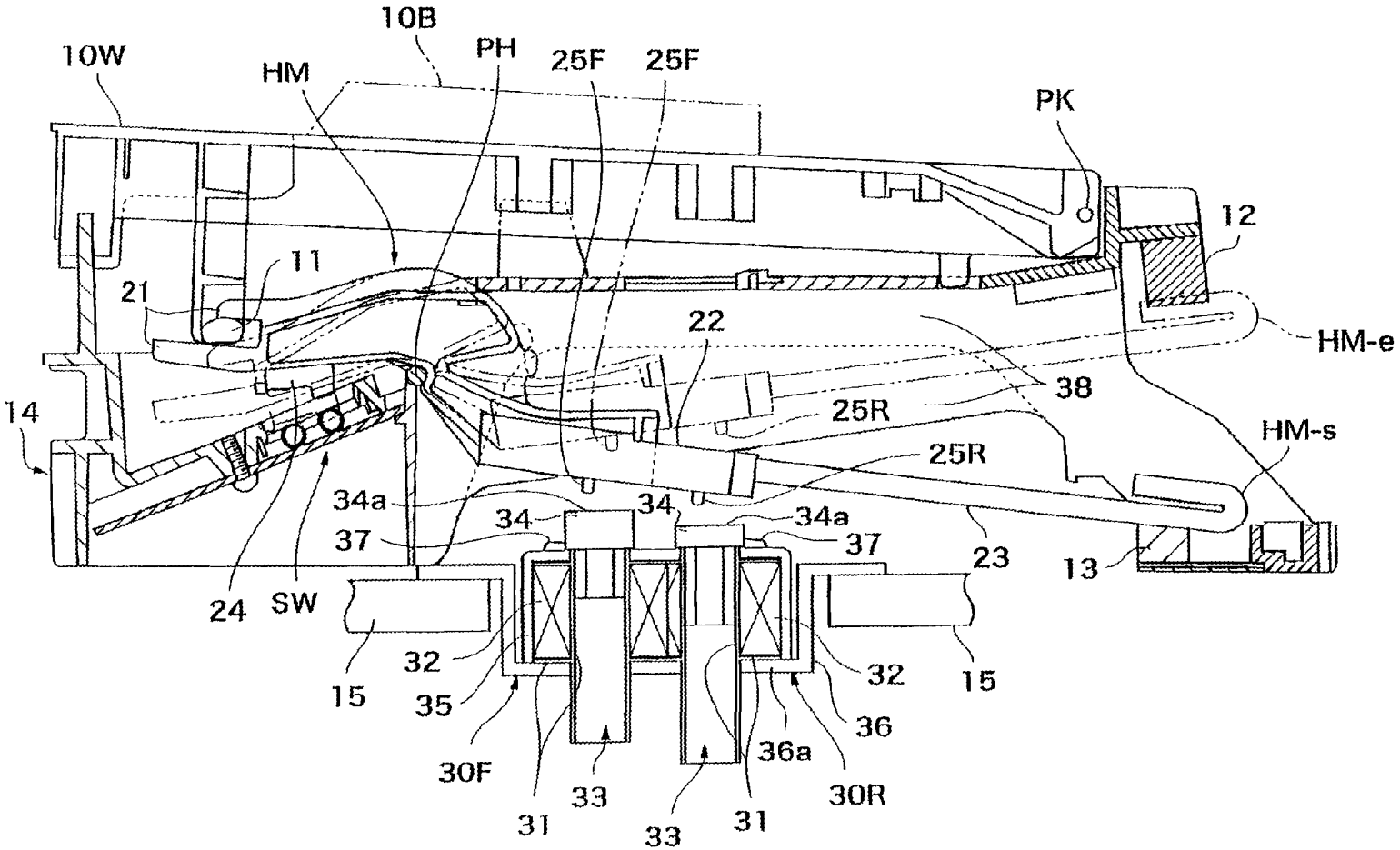
FIG. 1 is a partly cross-sectional side view showing an embodiment of a keyboard assembly having actuator devices, swing weights and keys according to the present invention.

FIG. 1 is a partly cross-sectional side view showing a first embodiment of a keyboard assembly according to the present invention.

The keyboard assembly is applicable to an electronic keyboard musical instrument for playing music automatically. As illustrated in FIG. 1, the keyboard assembly comprises a plurality of keys 10 disposed in parallel side by side and juxtaposed in the direction from left to right with respect to the keyboard player, and the same plurality of swing weights HM also disposed in parallel side by side and juxtaposed in the direction of the key juxtaposition, each of the keys 10 and each of the swing weights HM being supported individually on a chassis 14, each of the keys 10 corresponding to each of the swing weights HM. The key 10 is swingable up and down in a vertical plane about a key swing fulcrum PK when depressed by the player. The keys 10 include a plurality of white keys (natural keys) 10W and a plurality of black keys (sharp/flat keys) 10B. The key 10 is provided with a swing weight actuating bar 11. For the sake of explanation herein, the side of the keyboard assembly toward the player (the left side in FIG. 1) is referred to as the "front" side, and the side away from the player (the right side in FIG. 1) is referred to as the "rear" side of the keyboard assembly.

Under each key 10 is provided a swing weight HM corresponding to the key 10. Each swing weight HM is individually swingable about a weight swing pivot PH. The swing weight HM has an engaging fork 21 engaging with the swing weight actuating bar 11 all the time so that the swing weight HM swings as interlocked with the key 10. As the player depress the key 10, the swing weight actuating bar 11 of the key 10 actuates the engaging fork 21 to rotate the swing weight HM about the weight swing pivot PH counterclockwise as viewed in FIG. 1 (i.e. in the direction of the key depression) providing an adequate inertia which gives a comfortable key touch feeling to the player. The structure and arrangement of all the keys 10 and all the swing weights are, respectively, the same.

Alternatively, the length of the swing weight for the white key 10W and that for the black key 10B may be different, so that, for example, the front part, before the weight swing pivot PH, of the swing weight HM for the white key 10W may be formed longer than the front part of the swing weight HM for the black key 10B. In such a case, the swing weight actuating bar 11 and the engaging fork 21 for the black key 10B will be located in the front side of the same two for the white key 10W.

The swing weight HM comprises, in its rear part of the weight swing pivot PH, a base 22, from which is extended a weight member 23. The swing weight HM is normally urged clockwise as viewed in FIG. 1 (i.e. in the direction of the key release) by gravity due to the weight of the weight member 23, and locates at a position HM-s under the initial condition i.e. the key-undepressed condition. In FIG. 1, the position of the swing weight HM under the key-depressed condition is shown by HM-e in phantom, but the key 10 is shown in its undepressed condition only. The key 10 returns from its depressed condition to its undepressed condition by the returning movement of the swing weight HM due to the weight of the weight member 23. In the returning movement, the swing weight HM turns as interlocked with the corresponding key 10. Alternatively, a returning spring may be provided as a supplementary means for generating the returning force to bring the swing weight HM back to the undepressed position.

The chassis 14 is provided with an upper stopper 12 and a lower stopper 13 made of felt and the like at its upper rear end and the lower rear end, respectively. The upper stopper 12 determines the end position of the key depression, as the key 10 is depressed and the weight member 23 of the swing weight HM travels to abut against the upper stopper 12. The lower stopper 13 determines the end position of the key release, as the key 10 is released and the weight member 23 travels to abut against the lower stopper 13.

The keyboard assembly is also provided with key switches SW of a two-make type, each for each key. The key switch SW is actuated by a switch pusher 24 of the swing weight HM, and detects the key movement including the key velocity. Under the manual mode of playing music in which the player manipulates the keys for a real-time musical performance, the detected conditions of the switch pusher 24 controls the generation of musical tones.

The keyboard assembly further comprises actuators 30 (30F and 30R) as the actuator devices for playing music automatically, each actuator 30 corresponding to each of the swing weights HM. All the actuators 30 are of the same structure, except the disposed locations.

Figure 2A:
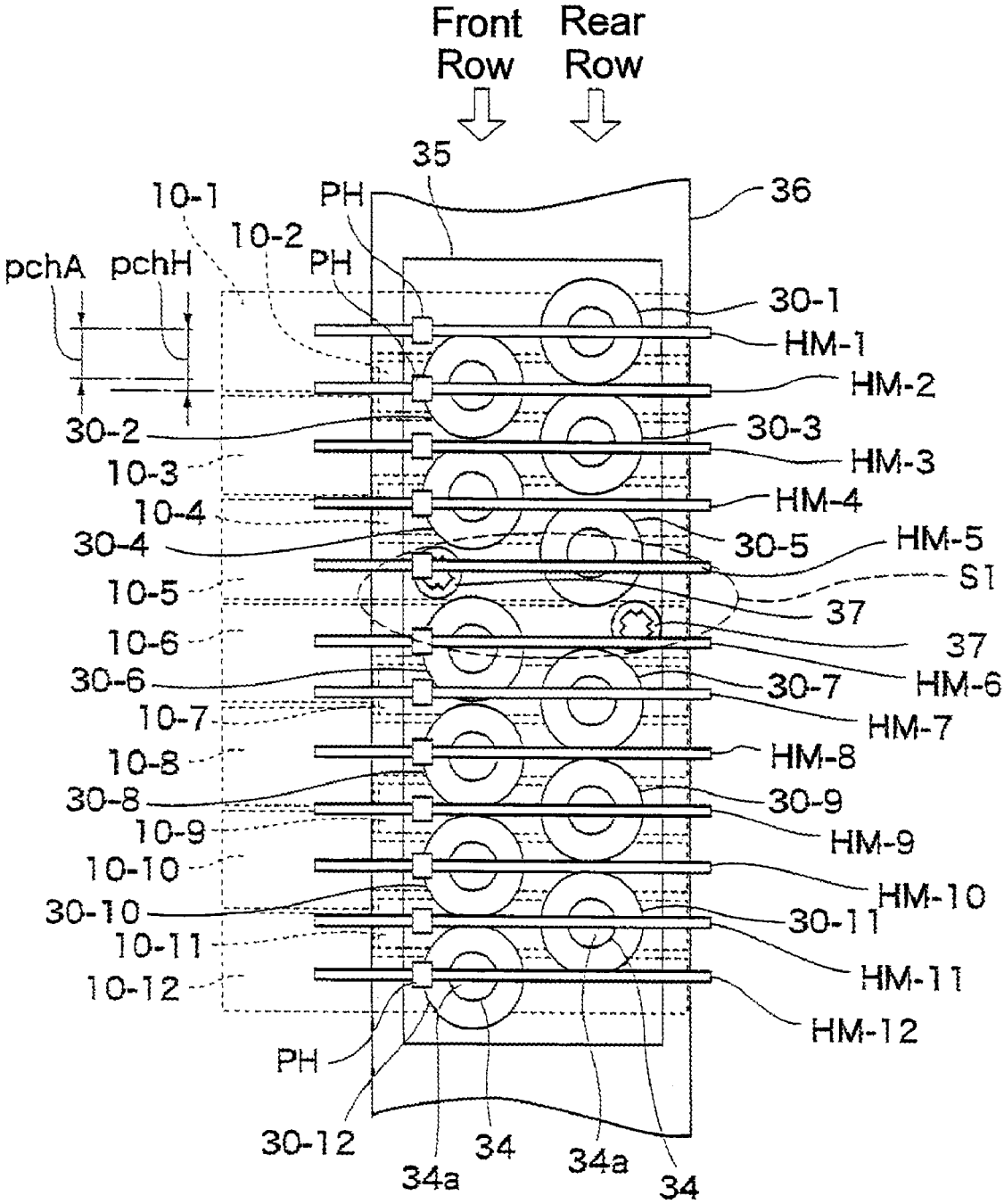
FIG. 2*a* is a plan view showing the actuating mechanism including the actuator devices, the swing weights and the keys (in phantom) for the range of one octave in the embodiment of FIG. 1.
Figure 2B:
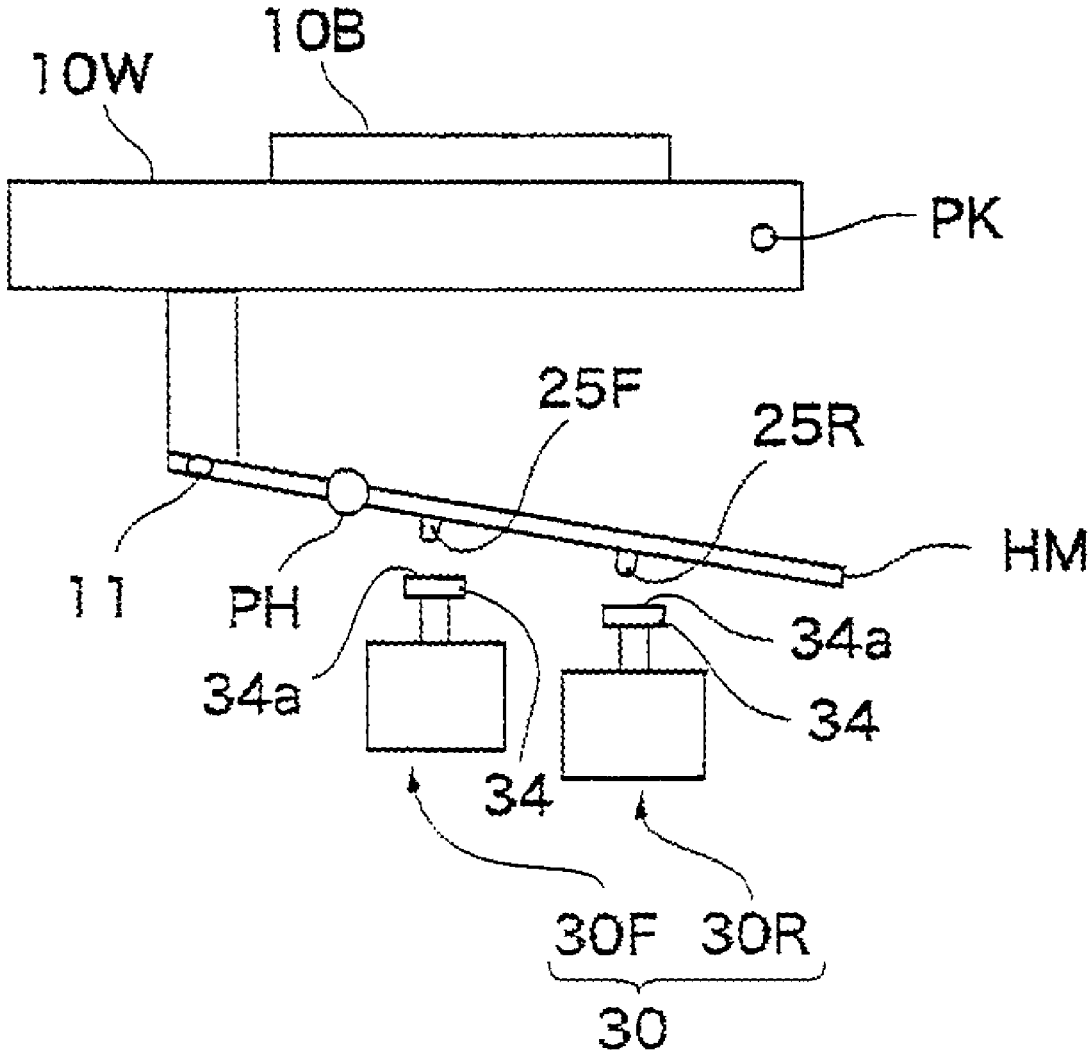
FIG. 2*b* is a schematic side view showing the actuating mechanism of FIG. 2*a;*

FIG. 2*a* is a plan view showing a part of the keyboard assembly for the range of one octave where the actuators 30 and the swing weights HM are disposed, and FIG. 2*b* is a schematic side view showing the actuating mechanism including the actuators 30, swing weights HM and the keys 10 (in phantom). While the keys 10 are categorized into white keys and black keys by reference characters "10W" and "10B," respectively, the keys 10 are also identified as "10-1," "10-2," - - - , "10-12" to indicate the individual keys by counting numbers from the C key upward in one octave, as shown in FIG. 2*a*. For example, the white key 10W for the C key is identified by "key 10-1" and the black key 10B for the C# key is identified by "key 10-2." The swing weights HM within one octave are likewise identified by reference characters "HM-1," "HM-2," - - - , "HM-12" to indicate the individual swing weights HM by counting numbers from the C upward.

The actuators 30 arrayed in two rows, a front row and a rear row, each row lying parallel in the direction of the key juxtaposition. When the actuators 30 are generally categorized into the front row and the rear row to which they belong, the actuators in the front row are identified by "30F" and the actuators in the rear row are identified by "30R." When the actuators 30 are to be identified individually by counting numbers from the C actuator upward within one octave, they are identified by reference characters "30-1," "30-2," - - - , "30-12" as in the case of the keys 10 and of the swing weights HM.

As shown in FIG. 1, the actuator 30 comprises a bobbin 31, a solenoid coil 32 wound around the bobbin 31 and a plunger 33 to reciprocate through the bobbin 31. The plunger 33 is provided at its upper end with an actuating member 34 of a disk shape integrally formed or else, having a flat top 34*a*.

As shown in FIGS. 1 and 2*a*, a common yoke 36 which are common to all the keys is mounted on the key bed 15. The common yoke 36 has a bottom plate 36*a* (FIG. 1), on which is fixed an upper yoke 35 of a predetermined length (e.g. a length for one octave) by means of screws 37. The actuator 30 comprises a magnetic path established by the upper yoke 35 and the common yoke 36. The fixing screws 37 also serves for fixing the actuator 30 in between the upper yoke 35 and the common yoke 36. The configuration and arrangement of the actuators 30 are alike also in the other octaves.

The base 22 of the swing weight HM has two protrusions 25 extending downward at a front and rear points above the front and rear rows, respectively, to serve as actuated members (i.e. actuation receptors). The front protrusion is indicated by "25F" and the rear protrusion by "25B," both of which are of the same structure. For example, the base 22 is made of resin and the protrusions 25 are formed integral with the base 22, but alternatively the protrusions 25 may be made separately and fixed to the bass 22.

The actuators 30F and 30R are disposed approximately just below the protrusions 25F and 25R, respectively, of the swing weight HM, wherein each swing weight HM corresponds to either one of the actuators 30F and 30R, which are arrayed zigzag in two rows. Thus, within an octave, the odd-numbered swing weight HM as counted from the C end is actuated by the actuator 30R in the rear row via the protrusion 25R, with the protrusion 25F unused. On the other hand, the even-numbered swing weight HM as counted from the C end is actuated by the actuator 30F in the front row via the protrusion 25F, with the protrusion 25R unused.

In the shown embodiment, key scaling of the key touches are not employed. Which means that the swing weights HM for the white keys 10W are the same in shape and in weight for all the keys 10W irrespective of the key names (note pitches), and the swing weights HM for the black keys 10B are the same for all the keys 10B. Thus, there are no more than two kinds of swing weights HM, for white keys and for black keys. This situation is made possible by the fact that each swing weight HM has two protrusions 25F and 25R, but only one of the two is in fact used by the corresponding actuator 30F or 25R, as the actuators 30 are alternately arrayed zigzag in the front row and the rear row. Even if three or more kinds of swing weights HM are provided, one kind can be commonly used for a plurality of actuators. For example, if a key scaling is employed by a predetermined range such as an octave (e.g. one octave after another), the swing weights HM of the same structure for white keys 10W can be commonly used for a plurality of white keys within a group of white keys, while the swing weights HM of the same structure for black keys 10B can be commonly used for a plurality of black keys within a group of black keys.

Under the undepressed condition of the key 10, the actuating member 34 of the plunger 33 is situated close to but apart from the protrusion 25 (the one of the protrusions 25F and 25R that locates above the actuator 30). Alternatively, the actuating member 34 may be in touch with the protrusion 25 under the undepressed condition. As the solenoid coil 32 is energized, the plunger 33 moves upward so that the actuating member 34 abuts against the protrusion 25 and pushes up the swing weight HM. Then the key 10 swings to the depressed position (the front part of the key 10 moves downward) as interlocked with the swing weight HM.

When the solenoid coil 32 is de-energized, the swing weight HM and the key 10 return to their rest positions, and the plunger 33 is pushed down via the protrusion 25 of the swing weight HM as well as pulled by gravity to return to its initial position (as shown in FIG. 1). A return spring or the like may be provided to forcibly return the plunger 33, thereby quickening the returning movement.

As described above and shown in FIG. 2*a*, the actuators 30 are alternately arrayed zigzag in two rows, the front row and the rear row extending in the direction of the key juxtaposition. Namely, within an octave, the actuators 30 which correspond to the odd-numbered keys as counted from the lowest note key are arrayed in the rear row, while the actuators 30 which correspond to the even-numbered keys as counted from the lowest note key are arrayed in the front row. For example, the actuator 30-1 that corresponds to the C key is disposed in the rear row, and the actuator 30-2 that corresponds to the C# key is disposed in the front row.

Also as shown in FIG. 2, the juxtaposition pitches of the keys 10 (i.e. the spacings between the width centers of adjacent keys) are not uniform throughout an octave, and the pitches among the keys C through E are a bit wider than the pitches among the keys F through B. The swing weights are generally disposed according to the pitches among the keys so that each of the swing weights HM for the black keys 10B is disposed approximately right below the lateral center of the corresponding black key 10B and each of the swing weights HM for the white keys 10W is disposed approximately right below the lateral center of the narrowed part (the part adjoining a black key) of the corresponding white key 10W. The juxtaposition pitches of the swing weights HM are accordingly not uniform throughout an octave. The distance between the lateral centers of a pair of adjacent swing weights HM is hereinafter defined as a "swing weight spacing pitch pchH," as shown in FIG. 2*a*. Similarly, the distance between the lateral centers of a pair of adjacent actuators 30 is defined as an "actuator arraying pitch pchA."

It should be noted here that the swing weight spacing pitch pchH and the actuator arraying pitch pchA are not always the same for the same pair of corresponding keys and that every actuator 30 is not necessarily disposed right below the corresponding swing weight HM, in other words, the location in the direction of the key juxtaposition of the actuator is individually different relative to the location of the corresponding swing weight. Specifically, in the embodiment shown in FIG. 2*a*, the actuators 30-1 through 30-5 are disposed closer toward the lowest note end of the octave, while the actuators 30-6 through 30-12 closer toward the highest note end. For example, the actuator arraying pitch pchA between the actuators 30-1 and 30-2 is narrower than the swing weight spacing pitch pchH between the swing weights HM-1 and HM-2 for the C and C# keys, respectively.

Thus, a wider area S1 is obtained between the actuators 30-5 and 30-7 and between the actuators 30-4 and 30-6. The above-mentioned screws 37 are screwed in this wider area S1. Although it would be difficult to secure a sufficient space for disposing screws, if the actuators 30 were arrayed at the like pitches as the disposition pitches of the swing weight HM as in the case of the conventional keyboard, the improved disposition of the actuators in this embodiment can afford an adequate area for the screws 37 without difficulty.

Besides, the location of the wider area S1 is not necessarily limited to the place shown in FIG. 2*a*, but may be selected at other places depending on how the actuators 30 are disposed. Further, the thus generate wider area S1 is not necessarily used only for fixing the actuators 30, but may be also used for fixing the common yoke 36 to a stationary member such as the key bed 15 in the keyboard assembly. Still further, the elements to be accommodated in the wider area S1 may include not only the fixing members such as the screws 37, but also additional components such as a temperature sensor for the fail-safe system to monitor the heat generation due to the power consumption by the electric current in the solenoid coil 32.

Figure 3A:
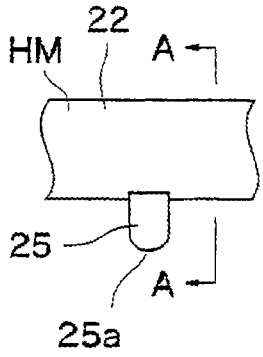
FIG. 3*a* is a partial side view of the swing weight in the embodiment of FIG. 1.
Figure 3B:
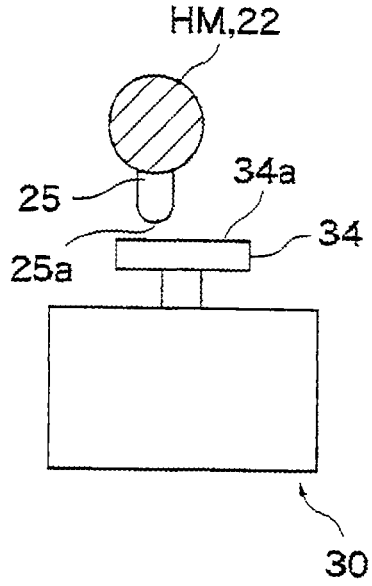
FIG. 3*b* is a rear view of the swing weight partly in cross section taken along the arrow line A-A of FIG. 3*a* together with a rear view of the actuator device in the embodiment of FIG. 1.
Figure 4:
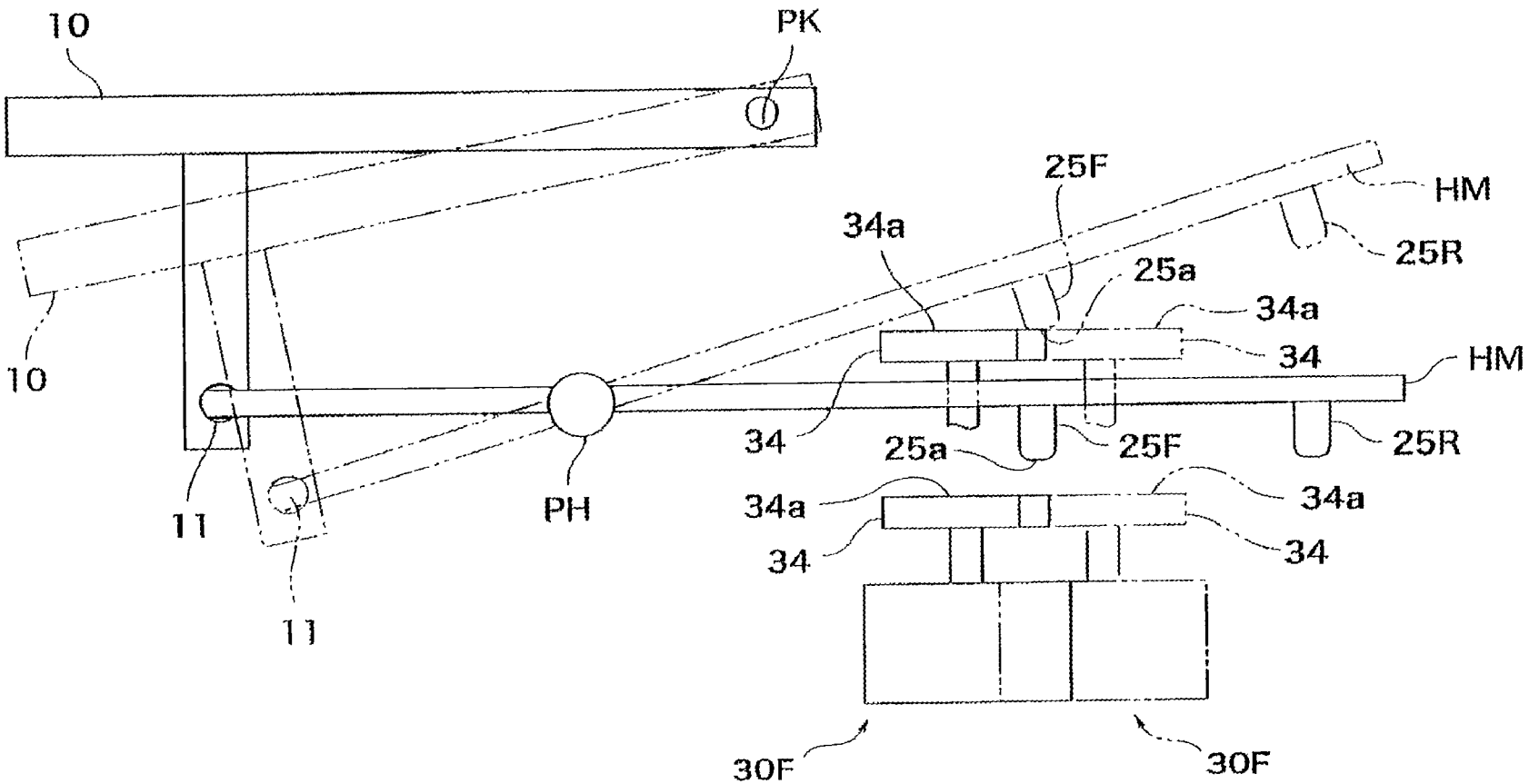
FIG. 4 is a schematic side view showing the actuating mechanism of FIG. 2*a;*

FIG. 3*a* is a side view of the part of the base 22 of the swing weight where the protrusion 25 is provided, and FIG. 3*b* is a rear view of the swing weight partly in cross section taken along the arrow line A-A of FIG. 3*a* together with a rear view of the actuator 30. FIG. 4 is a schematic side view showing the actuating mechanism including the actuator 30, the swing weight HM and the key 10. FIG. 4 shows the case in which the actuator 30F in the front row actuates the front protrusion 25F.

As shown in FIGS. 3*a* and 3*b*, the lower end of the protrusion 25 is shaped hemispherical as a rounded tip 25*a*. When the actuator 30 actuates the swing weight HM, the flat top 34*a* of the actuating member 34 abuts against the rounded tip 25*a* of the protrusion 25. The gap between the flat top 34*a* and the rounded tip 25*a* under the undepressed condition of the key 10 may not be limited to those shown in FIGS. 3*b* and 4, but may be much smaller or nil (touching). As the actuated swing weight HM rotates, the axial direction of the protrusion 25 varies with respect to the flat top 34*a*. However, the rounded tip 25*a* of a hemispheric shape causes a smooth change of the abutting point between the rounded tip 25*a* and the flat top 34*a* throughout the travel of the actuating member 34, which secures a proper actuation of the swing weight HM and then of the key 10.

The flat top 34*a* is parallel to the upper plane of the bottom plate 36*a* of the common yoke 36 and to the key bed 15. The direction of travel of the plunger 33 is perpendicular to the planes of these members. Strictly speaking, the position of the actuator 30, and more particularly, of the actuating member 34 may deviate inadvertently from the designed position due to the dimensional tolerance of the component itself and the assembly tolerance of the actuator 30, the upper yoke 35, the common yoke 36 and so forth. Further, the positional deviation may occur after the assemblage due to secular changes including environmental changes.

However, with the embodiment of the above described structure, the flat top 34*a* of the actuating member 34 actuates the protrusion 25 without suffering from adverse influence as will be explained with reference to FIG. 4 illustrating an exaggerated depiction of the components. If, for example, the position of the actuating member 34 might deviate frontward or rearward to some extent, the abutment between the flat top 34*a* and the rounded tip 25*a* will be maintained so that the amount of upward/downward movement of the protrusion 25 is unchanged and the distance between the protrusion 25 and the weight swing pivot PH is constant. Thus, the actual stroke of the key 10 and of the swing weight HM, and the angular moment given by the actuating member 34 are maintained properly. This explains a substantial increase in tolerance of the positional deviation of the actuator 30.

The positional deviation of the actuator 30 is tolerated not only in the forward and backward direction but also in the lateral direction, i.e. the direction of the key juxtaposition. In addition, as the pitch of the swing weight juxtaposition pchH is different from the pitch of the actuator juxtaposition pchA at some places in an octave, some actuator 30 has the center axis of the flat top 34*a* of the actuating member 34 deviated from the protrusion 25 due to the design as shown in FIG. 3*b*. Even though there is such a positional deviation existing, however, the stroke of the key 10 and the angular moment exerted on the key 10 will not be influenced, as the swing weight HM receives an actuation force via the protrusion 25 without fail, and on the other hand, the protrusion is provided in the lateral center (in the direction of the juxtaposition) of the base 22 of the swing weight HM.

Figure 3C:
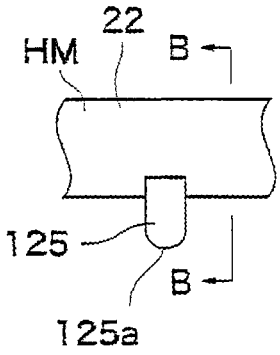
FIG. 3*c* is a partial side view of a modified swing weight.
Figure 3D:
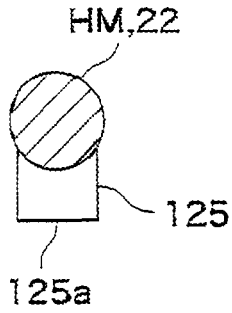
FIG. 3*d* is a rear view of the swing weight partly in cross section taken along the arrow line B-B of FIG. 3*c;*

FIG. 3*c* is a side view of a part of the base 22 of the swing weight where a modified protrusion is provided, and FIG. 3*d* is a rear view of the swing weight HM partly in cross section taken along the arrow line B-B of FIG. 3*c*. As shown in FIGS. 3*c* and 3*d*, the rounded tip 125*a* of the protrusion 125 may be semicylindrical appearing semicircular in the side view and rectangular in the rear view, rather than hemispherical. This configuration would be advantageous in that the flat top 34*a* abuts against the protrusion 125 in line contact rather than point contact, which increases the abrasion resistance and keeps the accuracy of the key actuation for a long time.

The shape of the tip of the protrusion 25, 125 may not necessarily be limited to those illustrated above. In particular, from the viewpoint of increasing endurance of the abutting part, the protrusion 25, 125 will only have to be devoid of an angled edge at the part which abuts the flat top 34*a*. For example, the shape may be arcuately convex in its side view. Or, the protrusion 25 may have a flattened tip 25*b* and rounded edges 25*c* at least at its front and rear corners connecting to the flattened tip 25*b* as shown by a modified protrusion 25 in FIG. 3*e*.

Figure 5A:
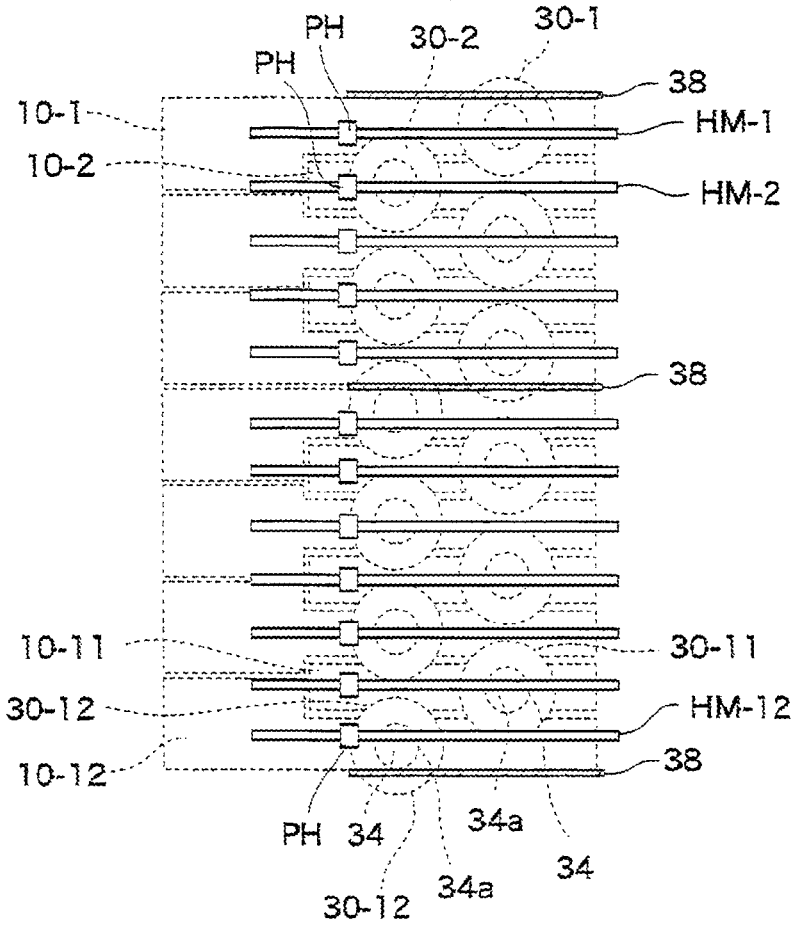
FIG. 5*a* is a plan view showing a modified embodiment of the actuating mechanism including the actuator devices, the swing weights and the keys (in phantom) for the range of one octave.
Figure 5B:
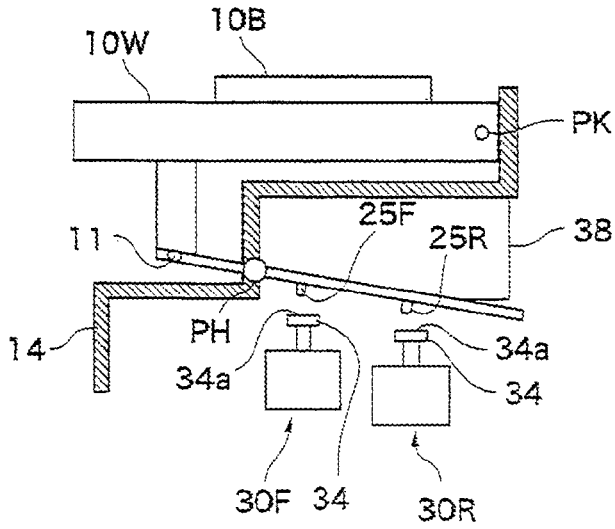
FIG. 5*b* is a schematic side view showing the actuating mechanism of FIG. 5*a;*

FIG. 5*a* is a plan view showing a modified example of the above described embodiment including the actuator devices, the swing weights and the keys (in phantom) for the range of one octave, in which the actuators are arrayed differently than FIG. 2. FIG. 5*b* is a schematic side view showing the actuating mechanism of the modified embodiment of FIG. 5*a*.

In the example of FIG. 5*a*, the actuators 30-1 through 30-12 are alternately arrayed zigzag in two rows, the front row and the rear row extending in the direction of the key juxtaposition as in the case of FIG. 2*a*, but arrayed with equal spacing in the direction of the key juxtaposition. The actuators 30F in the front row and the actuators 30R in the rear row are arrayed, respectively, with equal spacing in the respective rows. In the case of a plastic chassis 14, there will be provided ribs 38 along the direction parallel to the respective swing weights HM for reinforcing the chassis structure as shown in FIGS. 5*a* and 5*b*. The swing weights HM are disposed circumventing such ribs 38 accordingly (see also FIG. 1). Thus, the swing weights HM can not be disposed with equal spacing, but with wider spacing in some region and with narrower spacing in the other region.

With this embodiment, however, the actuators 30 are disposed with equal spacing independently of the arrayed pattern of the swing weights HM, and so can be designed in a common maximized size. While the zigzag arraying permits efficient disposition of the actuators 30 and is advantageous in enlarging the size of the actuators 30, the equal spacing further helps in maximizing the size of the actuators 30.

The first embodiment includes a region in which the pitch pchH of the swing weight juxtaposition is different from the pitch pchA of the actuator juxtaposition, and therefore, permits a space among the swing weights for accommodating fixing members or some other components (see FIG. 2*a*) and permits an equal spacing of the actuators 30 for maximizing the size thereof, thereby enhancing freedom in designing the keyboard assembly (see FIG. 5*a*). In particular, the modified embodiment of FIGS. 5*a* and 5*b* permits maximization of the size of the actuators 30, and accordingly the efficiency per electricity consumption will be increased, which will be advantageous in miniaturization of the power source, which in turn contributes to the miniaturization of the entire keyboard assembly.

The arraying pattern of the actuators 30 can be arbitrarily determined according to the intention of the designer, and so the pitch pchH of the swing weights HM may be equal to the pitch pchA of the actuators 30 at some region in the keyboard assembly. In the example of FIG. 5*a*, the actuators 30 are arrayed with equal spacing independently of the unequal disposition of the swing weights HM to circumvent the ribs 38, but the equal spacing of the actuators 30 may be advantageously employed in maximizing the size thereof irrespective of the necessity of coping with such restrictions.

According to this embodiment, the actuator 30 actuates the swing weight HM with the flat top 34*a* of the actuating member 34 abutting against the rounded tip 25*a* of the protrusion 25, which enlarges the tolerance for the positional deviation of the actuator 30 and reduces possible failures or incorrectness of the key actuation due to fabrication errors and secular changes.

The hemispheric shape of the rounded tip 25*a* of the protrusion 25 helps in maintaining smooth abutment between the flat top 34*a* and the rounded tip 25*a* throughout the key actuating stroke, thereby ensuring accurate key actuations. Further, the protrusion 25 devoid of angled edges at the abutting point against the flat top 34*a* of the actuating member 34 is advantageous in enhancing the durability of the abutting parts of the actuating member 34 and the protrusion 25.

Every swing weight HM is provided with two protrusions at the positions that correspond to the two actuator rows and only one of the two that corresponds to the existing actuators 30 is actually actuated and the other is not used, which configuration makes only one kind of swing weights available for a plurality of keys in common and the number of kinds of swing weights will not be increased uselessly.

At least one pair of the pitch pchh between the adjacent swing weights and the pitch pchA between the adjacent actuators will be useful for the purpose of enhancing freedom in designing.

Second Embodiment

Figure 6A:
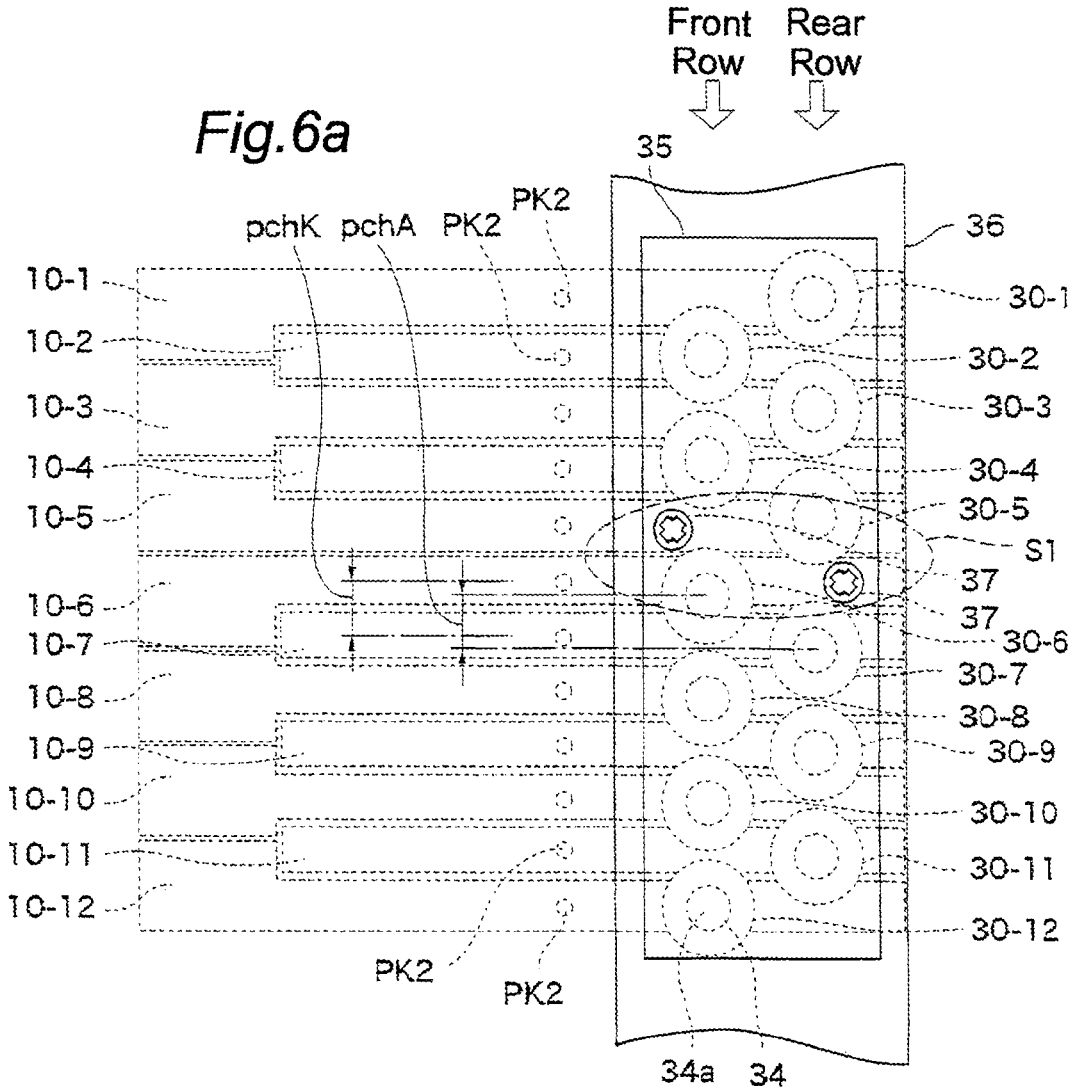
FIG. 6*a* is a plan view showing the actuating mechanism including the actuator devices and the keys (in phantom) for the range of one octave in another embodiment of a keyboard assembly according to the present invention.
Figure 6B:
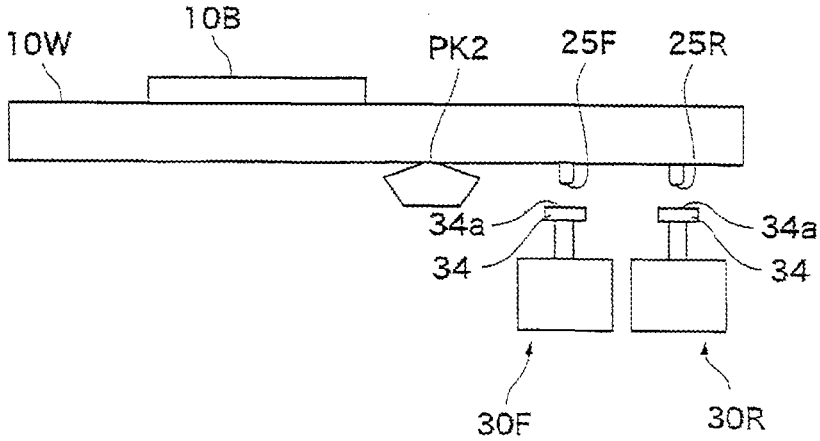
FIG. 6*b* is a schematic side view showing the actuating mechanism of FIG. 6*a;*

FIG. 6*a* is a plan view showing the actuating mechanism including the actuator devices and the keys (in phantom) for the range of one octave in a second embodiment of a keyboard assembly according to the present invention. FIG. 6*b* is a schematic side view showing the actuating mechanism of FIG. 6*a*.

In the first embodiment above, the keyboard assembly comprises swing weights HM in addition to the keys 10 and the actuators 30. In the second embodiment, however, the keyboard assembly comprises keys 10 and actuators 30, and not swing weights HM, so that each of the actuators 30 directly actuates each corresponding one of the keys 10.

In FIG. 6*b*, the key 10 (white key 10W or black key 10B) is supported by a key swing fulcrum PK2 to be swingable about the fulcrum PK2 in the key depression/release direction. The protrusions 25F and 25R which are provided on the swing weight HM in the first embodiment are now provided, in the example shown in FIG. 6*b*, on the lower surface of the key 10 near its rear end. Actuators 30 are disposed below the protrusions 25 with the arraying configuration in the same way as the first embodiment, such as in two rows (see FIG. 6*a*). Other arrangements in connection with the actuators 30 are the same as the first embodiment. As indicated by example in FIG. 6*a*, the distance between the lateral centers of the adjacent keys 10 (in the case of the white key 10W, the lateral center of the narrowed rear part thereof confronting the black key 10B) is termed the "pitch pchK of the key juxtaposition."

In this embodiment also, the arraying pattern of the actuators 30 in the direction of the key juxtaposition is designed in the same way as FIG. 2*a* to secure a wider area S1 for screws 37. More specifically, the keys 10 are arrayed in the same way as in the first embodiment with the different spacings for the keys C through E and for the keys F through B within an octave, while the actuators 30 arrayed with an equal spacing for the C actuator through E actuator and for the F actuator through B actuator except the spacing between the E actuator and the F actuator where the wider area S1 is provided for the screws 37, thus causing a positional deviation of each actuator 30 from the corresponding key 10 individually. The pitch pchK of the key juxtaposition will be accordingly different at some locations from the pitch pchA of the actuator juxtaposition.

Figure 7:
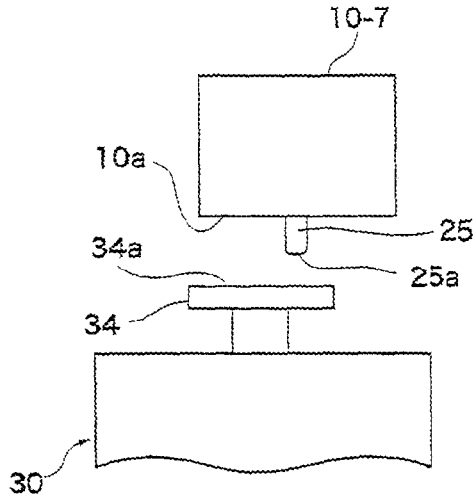
FIG. 7 is a schematic rear view showing the F# key and the actuator device in the embodiment of FIG. 6*a;*

FIG. 7 is a schematic rear view showing the key 10-7 (F# black key 10B) and the actuator device 30-7 in the embodiment of FIG. 6*a*. The protrusion 25 is provided at the lateral (in the direction of the key juxtaposition) center of the key 10-7 on the lower surface 10*a* thereof. Although the flat top 34*a* of the actuating member 34 is not in axial alignment with the protrusion 25 in design, the key 10-7 receives an actuating force through the laterally centered protrusion 25 at its rounded tip 25*a*. Thus, the key 10-7 is properly actuated with no rolling torque developed therein.

The situation is the same with the other keys including black the keys 10B. The protrusion 25 of the white key 10W is provided at the lateral center of the narrowed rear part which confronts a black key 10B.

Figure 8:
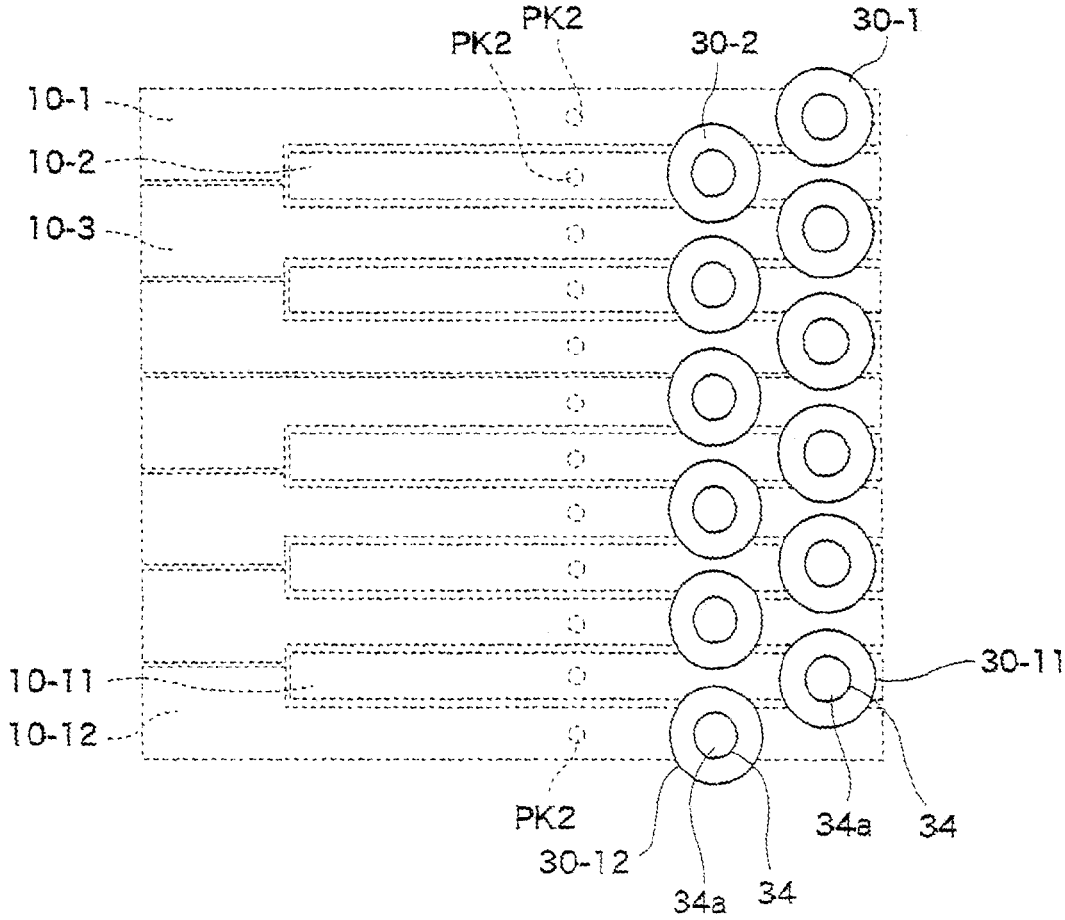
FIG. 8 is a plan view of a modified arrangement of the actuator devices for the range of one octave in the embodiment of FIG. 6*a;*

FIG. 8 is a plan view of a modified arrangement of the actuators 30 for the range of one octave in the second embodiment of FIG. 6*a*. In the example of FIG. 8, the keys 10 are arrayed regularly with unequal spacing, but the actuators 30-1 through 30-12 are alternately arrayed zigzag in two rows with equal spacing in the direction of the key juxtaposition as in the case of FIG. 5*a*. In this modified example also, the actuators 30 are arranged with equal spacing independently of the arrayed pattern of the keys 10, and so the actuators 30 can be designed in a common size and in a maximum size.

Even though the arrayed positions of the corresponding keys 10 and actuators 30 are different in design in the direction of the key juxtaposition, each key 10 receives an actuating force at its lateral center through the protrusion 25 so that no rolling torque will be developed and a proper key actuation will be made, enhancing the durability of the keyboard assembly. In connection with these merits, the upper surface of the actuating member 34 may not necessarily be a flat top 34*a*.

With respect to the black keys 10B, a single type of black keys will suffice for all the black keys 10B throughout the keyboard assembly by providing two protrusions 25 and using either one of them according to the row in which the confronting actuator is disposed, suppressing the number of black key models to one.

With respect to the white keys 10W, the keys 10W are different from each other in shape, and accordingly provision of two protrusions 25 on a key will not suffice for using a common model for all the white keys 10W. However, the number of models of the white keys 10W can be reduced for some inexpensive keyboard musical instruments like toy instruments, as will be described below.

Figure 9A:
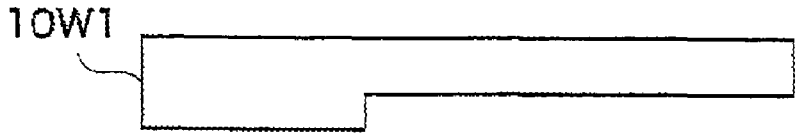
FIG. 9*a* is a plan view of a white key for C and F.
Figure 9B:
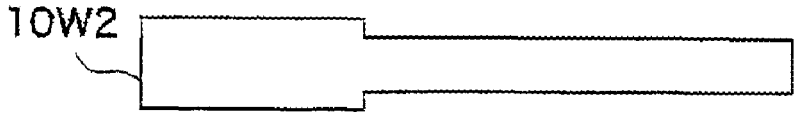
FIG. 9*b* is a plan view of a white key for D, G and A.
Figure 9C:
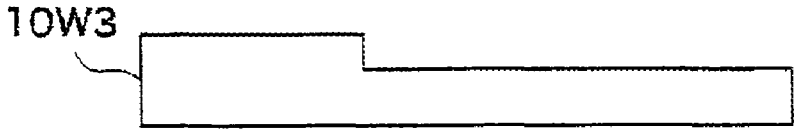
FIG. 9*c* is a plan view of a white key for E and B.

FIGS. 9*a*-9*c* are plan views of white keys in the case of reducing the number of models of white keys 10W. As shown in these Figures, three types of white keys 10W1, 10W2 and 10W3 are provided to be used for seven different white keys 10W. More specifically, the key 10W1 is used for the C and F keys, the key 10W2 for the D, G and A keys, and the key 10W3 for the E and B keys. Thus, the number of types can be reduced or the white keys 10.

While the above embodiment employs of the structure in which the keys 10 are actuated directly by the actuators 30, the present invention is also applicable to the structure in which the keys 10 are actuated indirectly.

Figure 9D:
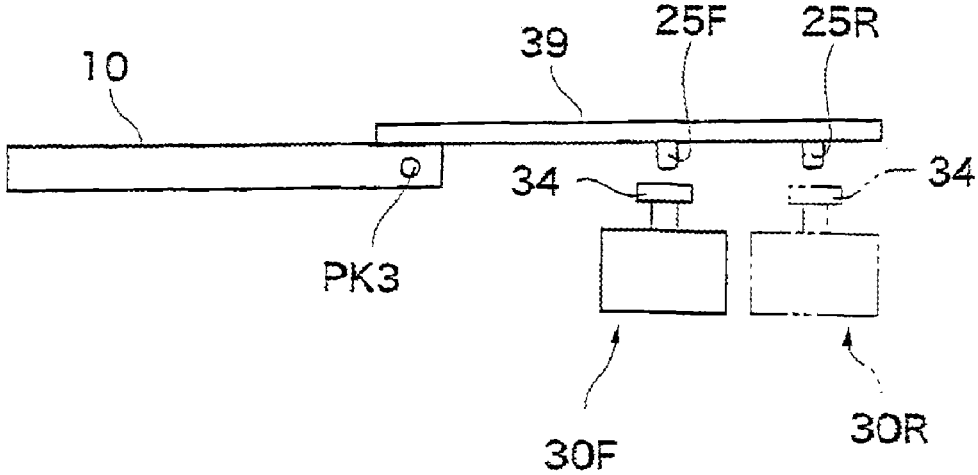
FIG. 9*d* is a schematic side view of a modified arrangement of the actuating mechanism including keys and actuator devices.

For example, as shown in FIG. 9*d*, an extension member 39 may be fixedly attached to the key 10 which is vertically swingable about a key swing fulcrum PK3 so that the key 10 and the extension member 39 moves integrally. The extension member 39 is provided with two protrusions 25F and 25R, and actuators 30F and 30R are provided to actuate the protrusions 25F and 25R, respectively. Thus, the keyboard assembly of this arrangement in which the keys are actuated via the extension members 39 attached to the respective keys has the same advantageous effect as the second embodiment described above.

Figure 3E:
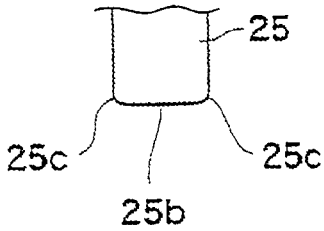
FIG. 3*e* is a partial elevational view of a modified protrusion from the swing weight.

In this example also, the protrusion 25 may be formed in the modified shapes as shown in FIGS. 3*c*, 3*d* and 3*e* as employed in the first embodiment.

When it comes to enhancing the freedom in designing by arraying the actuators 30 in an advantageous manner, it should be understood that the key 10 or the swing weight HM has only to be provided with an actuated member, and that the actuating member need not be of a protruded shape as the protrusion 25. Where the actuators 30 are arrayed with equal spacing, the equal spacing need not be extremely strict, but may be substantial. The smaller the differences among the spacings are, the more advantageous in maximizing the size of the actuators.

Further, when it comes to enhancing the freedom in designing by arraying the actuators 30 in an advantageous manner in the first and second embodiments, the arraying need not be in two rows, but may be in a single row or in three rows.

While, in the first and second embodiments above, the key or the swing weight is provided with two protrusions 25 to reduce the number of types (or models), the key or the swing weight may be provided with only one protrusion 25 at the position to be actually actuated by the actuator 30, if the reduction of the number of types (or models) is not intended.

From the viewpoint of reducing the number of types of the keys 10 or the swing weights HM by providing two or more protrusions 25 per key or swing weight, it should be understood that the actuators 30 have only to be disposed in a plurality of rows and at the positions that correspond to the protrusions 25, and may not be alternately arrayed zigzag in two rows.

While the first and second embodiments employ solenoid coils 32 and plungers 33 as the actuators 30 for example, the actuators 30 may not be limited to such a structure, but may be of other types such as electric motors and piezo-electric devices.

Further, while the first and second embodiments are of the examples where the keyboard assembly of the present invention is applied to an electronic keyboard musical instrument having no musical strings, the present invention is also applicable to a keyboard musical instrument which has electronic tone generators and an acoustic piano strings, on which the player can play the instrument at some time as an acoustic instrument by striking the strings according to the manipulation of the keys, and at another time as an electronic instrument by prohibiting the string strikes in its silent mode and generating musical tones using the electronic tone generators according to the manipulation of the keys.

While several preferred embodiments have been described and illustrated in detail herein above with reference to the drawings, it should be understood that the illustrated embodiments are just for preferable examples and that the present invention can be practiced with various modifications without departing from the spirit of the present invention.

What is claimed is:

1. A keyboard assembly for playing music automatically comprising:

a plurality of juxtaposed keys including white keys and black keys and arrayed from left to right over octaves, each being supported swingable in a direction of depression and release thereof;

a plurality of swing weights juxtaposed in parallel with and respectively corresponding to the juxtaposed keys, each of the swing weights being supported swingable as interlocked with the corresponding one of the keys; and a plurality of electrically operated actuator devices, each being provided in correspondence to each of the swing weights to actuate the corresponding swing weight, which in turn drives the interlocked key to swing to its depressed position, wherein a distance, in the direction of the juxtaposition, between a pair of the actuator devices corresponding to a pair of the juxtaposed keys within an octave is different from a distance, in the direction of the juxtaposition, between a pair of the juxtaposed swing weights corresponding to the pair of the juxtaposed keys within the octave.

2. A keyboard assembly as claimed in claim 1, wherein the actuator devices are spaced equally within an octave, while the swing weights are spaced unequally within the same octave.

3. A keyboard assembly as claimed in any one of claims 1 and 2, wherein each of the actuator devices is arranged two rows which are defined in parallel to the direction of the key juxtaposition, and wherein the actuator devices which correspond to odd-numbered swing weights as counted from the left within each of the octaves are arranged in one of the two rows while the actuator devices which correspond to even-numbered swing weights as counted from the left within each of the octaves are arranged in the other of the two rows.

4. A keyboard assembly for playing music automatically comprising:

a plurality of juxtaposed keys including white keys and black keys and arrayed from left to right over octaves, each being supported swingable in a direction of depression and release thereof;

a plurality of electrically operated actuator devices, each being provided in correspondence to each of the keys to actuate the corresponding key to swing to its depressed position, wherein a distance, in the direction of the juxtaposition, between a pair of the actuator devices corresponding to a pair of the juxtaposed keys within an octave is different from a distance, in the direction of the juxtaposition, between a pair of the juxtaposed keys within the octave.

5. A keyboard assembly as claimed in claim 4, wherein the actuator devices are spaced equally within an octave, while the keys are spaced unequally within the same octave.

6. A keyboard assembly as claimed in any one of claims 4 and 5, wherein each of the actuator devices is arranged two rows which are defined in parallel to the direction of the key juxtaposition, and wherein the actuator devices which correspond to odd-numbered keys as counted from the left within each of the octaves are arranged in one of the two rows while the actuator devices which correspond to even-numbered keys as counted from the left within each of the octaves are arranged in the other of the two rows.

7. A keyboard assembly as claimed in any one of claims 4 and 5, wherein each of the keys has an actuated member in the form of a protrusion extending from the key on the center line of the key width toward the actuator device, and wherein each of the actuator devices has an actuating member to actuate the actuated member of the corresponding key to cause the key to swing to its depressed position.

8. A keyboard assembly as claimed in any one of claims 1 and 4, wherein each of the keys has an actuated member adjacent the actuator device, and wherein each of the actuator devices has an actuating member to actuate the actuated member of the corresponding key to cause the key to swing to its depressed position, and wherein the actuating member has a tip surface having a first area facing toward the actuated member and the actuated member has a tip surface having a second area facing toward the actuating member, the first area being greater than the second area.

* * * * *